US005158468A

United States Patent [19]

Curtis et al.

[11] Patent Number: 5,158,468

[45] Date of Patent: Oct. 27, 1992

[54] SELF-RETAINING CONTACT ASSEMBLY

[75] Inventors: James H. Curtis, Coral Springs; Jose Villanueva, III, Delray Beach; William R. Williams, North Lauderdale; James T. Davis, II, Sunrise; John M. Miller, Plantation, all of Fla.

[73] Assignee: Motorola, Inc., Schaumburg, Ill.

[21] Appl. No.: 802,974

[22] Filed: Dec. 6, 1991

[51] Int. Cl.[5] ..... H01R 9/09

[52] U.S. Cl. ..... 439/76; 439/81; 439/746; 439/884

[58] Field of Search ..... 439/76, 81, 733, 744, 439/746, 884

[56] References Cited

U.S. PATENT DOCUMENTS

| | | | |
|---|---|---|---|
| 3,883,207 | 5/1975 | Tomkiewicz | 439/746 |
| 3,997,236 | 12/1976 | Bresin | 339/221 |
| 4,226,496 | 10/1980 | Langham | 439/746 |
| 4,891,023 | 1/1990 | Lopata | 439/746 |
| 5,096,427 | 3/1992 | Sadigh-Behzadi | 439/76 |

FOREIGN PATENT DOCUMENTS

| | | | |
|---|---|---|---|
| 0808723 | 7/1951 | Fed. Rep. of Germany | 439/746 |

*Primary Examiner*—Paula A. Bradley
*Attorney, Agent, or Firm*—Pablo Meles

[57] ABSTRACT

An electrical contact assembly (10) comprises a housing having a bottom portion (26) and a top portion (24), the top portion having a first inverted wall section (29) and a second inverted wall section (28), the housing having at least one aperture (31 and 32), the aperture extending from the bottom of the first inverted wall section to the bottom of the second inverted wall section. The assembly further comprises a substrate (20) within the housing having at least one contact area (22), and a contact finger (11) for placement in the housing aperture, the contact finger having at least a first portion (12), a second portion (14) and a third portion (16). The first portion protrudes below the aperture and contacts the contact area (22) on the substrate. The second portion (14) clips on to opposing walls of the second inverted wall (28) and the third portion (16) protrudes from the aperture (31) forming an external contact area.

20 Claims, 3 Drawing Sheets

SELF-RETAINING CONTACT ASSEMBLY

TECHNICAL FIELD

This invention relates generally to electrical contacts in general and, more particularly, to a self-retaining electrical contact which is hand-insertable into a housing.

BACKGROUND

Most electrical contact assemblies require additional mounting structures to a housing such as rivets, screws, and other hardware, not to mention solder interconnections. In addition to the obvious increase in material and labor costs of manufacturing these contact assemblies, many require special tools to attach the contacts to the housing. Furthermore, the contact assemblies used in many products are difficult and impractical to repair. Additional mounting structures typically cause a decrease in the reliability of the contact structure. Therefore, there exists a need for a solderless contact assembly that allows for ease of assembly as well as disassembly and having a minimum of mounting structures.

SUMMARY OF THE INVENTION

An electrical contact for use in a housing having at least a first appending wall and a second appending wall comprises a contact finger substantially fitted on an inner wall of the first appending wall and on an outer wall of the second appending wall for placement in a housing aperture, the contact finger having at least a first portion, a second portion, and a third portion, the first portion protruding below the aperture and contacting a contact area on a substrate located within the housing, the second portion clipping on to opposing walls of the second appending wall and the third portion protruding from the aperture forming an external contact area.

DETAILED DESCRIPTION OF THE PREFERRED EMBODIMENT

Figure 1:
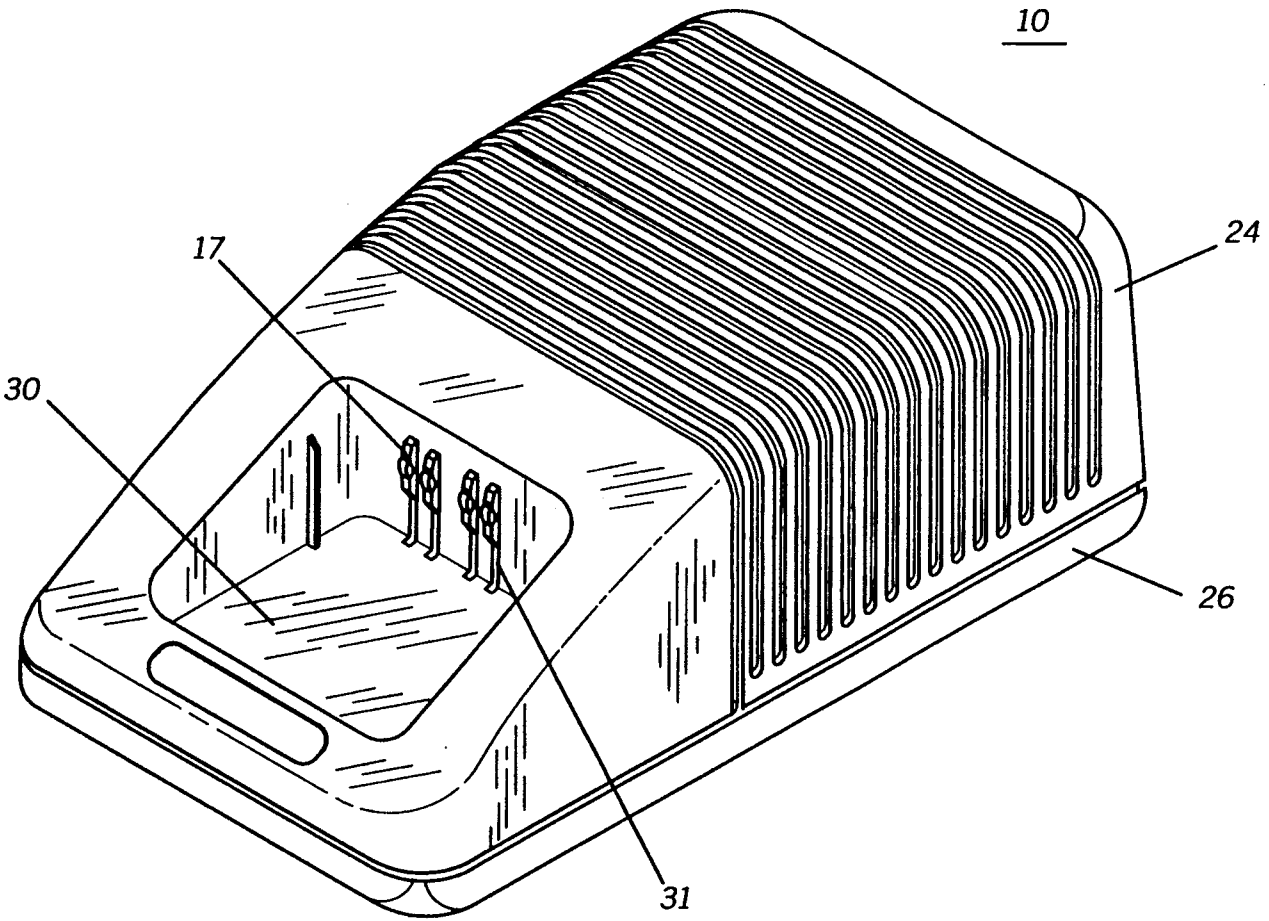
FIG. 1 is a perspective view of a charger housing and electronic contact assembly in accordance with the present invention.

Referring to FIG. 1 there is shown a perspective view of a charger housing and contact assembly 10 in accordance with the present invention. Preferably, the assembly 10 comprises a plastic bottom portion 26 and a plastic top portion 24 that snap together without using any special tooling or fasteners. The top portion 24 further preferably comprises a well 30 for receiving a rechargeable battery (not shown) having contacts (not shown) for mating with charger contacts 17 or contact fingers, or extending features that protrude from an aperture or opening 31 in the top housing portion 24.

Figure 2:
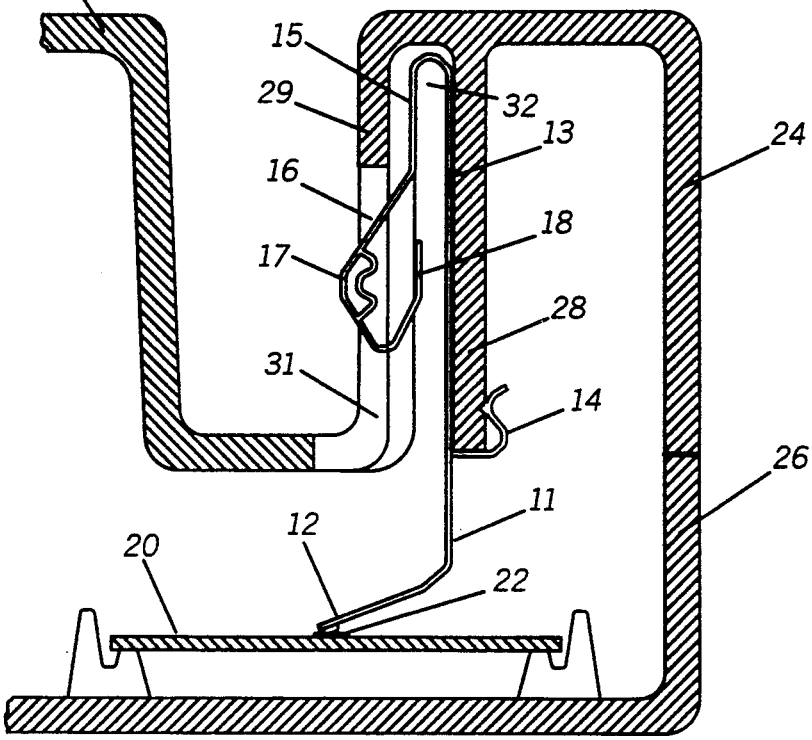
FIG. 2 is a cut view of a charger housing and electronic contact assembly in accordance with the present invention.

Referring to FIG. 2, there is shown a partial cut view of the charger housing and contact assembly 10. In further detail, the assembly 10 comprises a top housing portion 24 and a bottom housing portion 26 that retains a substrate or printed circuit board 20 within the housing assembly. The printed circuit board preferably includes a wiping contact surface 22 for contacting with a hand-insertable, hand removable self-locking electrical contact 11 that inserts and attaches itself to at least one of the walls 28 of the top housing portion 24. The top housing 24 preferably comprises a first appending wall or inverted wall 29 and a second appending wall or inverted wall 28. The first wall 29 preferably includes an aperture or opening 31 and another opening 32 wherein the electrical contact 11 is hand-inserted through. Preferably, the contact 11 comprises a first portion 12 that protrudes below the aperture 32 and is biased toward a contact pad 22 on the substrate 20. The contact 11 also comprises a second portion 14 that clips or forms a press fit to opposing sides of the appending wall 28. The contact further comprises a third portion 16 that protrudes from the aperture 31 that allows a rechargeable battery having contacts (not shown) to be charged via the contact 11. The third portion 16 preferably further includes an extending feature 17 that allows for better contact with the battery contacts even if the battery contacts are slightly recessed. The second portion 14 also includes members 13 and 15 that form an inverted J shaped construction that mates with portions of the walls 28 and 29. In other words, the contact 11 substantially fits on the inner wall of the first appending wall (29) and on an outer wall of the second appending wall (28) for placement in the top housing portion.

Figure 3:
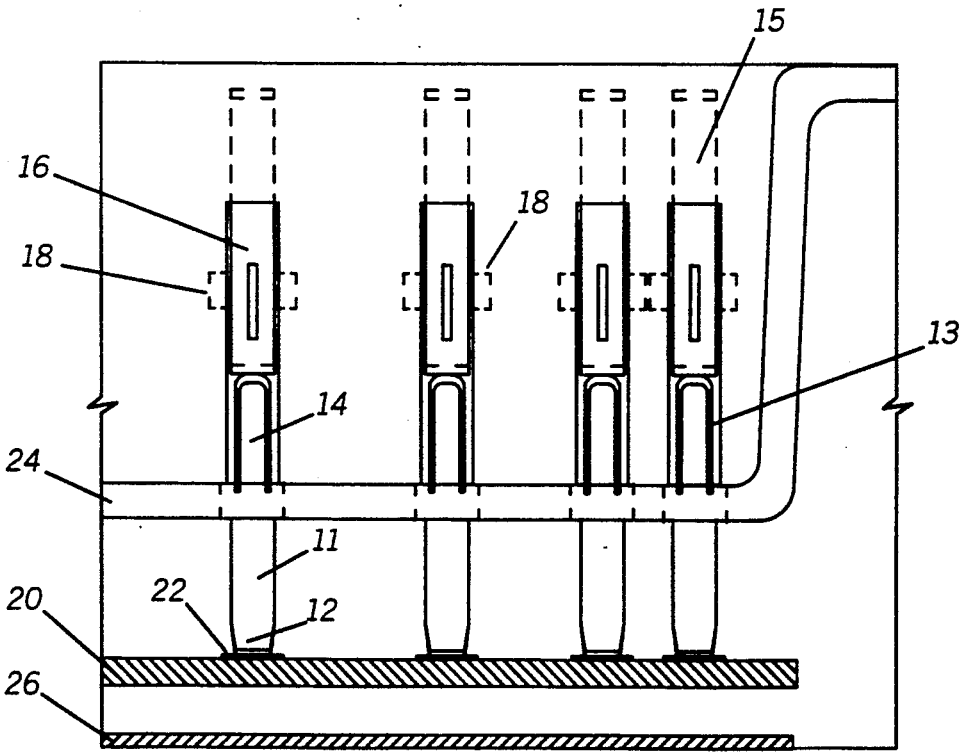
FIG. 3 is a frontal view of a charger housing and electronic contact assembly in accordance with the present invention.

Referring to FIG. 3, there is shown a partial front view of the charger housing and contact assembly 10. The contact 11 is preferably an integral piece of metal having portions 12, 14 and 16 slip fit within the top housing portion 24. The housing assembly is enclosed when the bottom housing portion 26 mates with the top housing portion 24. The substrate 20 having the contact pads 22 lies on the bottom housing portion 26. When the top and bottom housing portions (24 and 26) mate, the contact portion 12 becomes biased towards the contact pad 22 on the substrate 20. The contact is not easily removed externally since the contact portion 16 has a tongue portion 18 that is preferably wider than the width of the aperture 31. The contact 11 is easily removed after opening the housing by separating the top housing portion 24 from the bottom housing portion 26. The contact 11 including the portion 16 having the tongue portion 18 and extending feature 17 is easily hand-insertable and removable or replaceable.

The charger housing and contact assembly 10 is suitable for a variety of rechargeable batteries having different contact spacings or pitch. The different contact (11) spacings and heights could accomodate for different battery capacities or for different models without compromising in the alignment of the charger contact 11 with the battery contacts (not shown) and without compromising contact with the pads 22 on the printed circuit board 20. For instance, the top housing portion 24 could have a variable well (30) depth allowing for a variable contact height.

Figure 4:
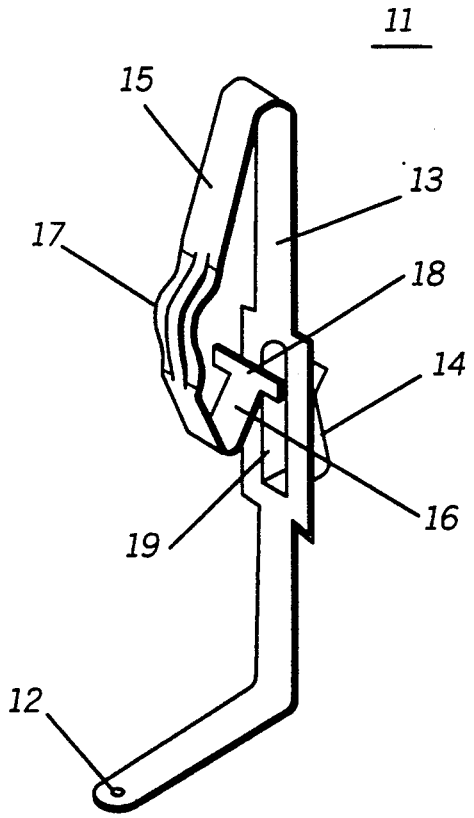
FIG. 4 is a perspective view of the electronic contact assembly in accordance with the present invention.

Referring to FIG. 4, there is shown a perspective view of the contact 11. As shown, the contact 11 again has a first portion 12 for providing contact to a substrate within the charger housing (not shown) and a mid-section or second portion 14 including an inverted J-shaped structure formed from members 13 and 15. Portion 12 provides good contact with the contact pad 22 on the substrate 20 as well as protecting the pad 22 from tin fretting by providing a wiping mechanism each time a battery is inserted into the well 30 of the battery charger housing 10 (see FIG. 1). The clip-on feature of the second portion 14 is formed by a stampedout member which creates the aperture 19 as shown. Finally, the third portion 16 of the contact 11 includes an extension feature 17 as well as a tongue 18. The feature 17 provides better contact with the connecting battery (not shown) and the tongue provides some spring action as well as some removal prevention of the contact for the housing.

What is claimed is:

1. An electrical contact assembly, comprising:

a housing having a bottom portion and a top portion, said top portion having a first inverted wall section and a second inverted wall section, said housing having at least one aperture, said aperture extending from the bottom of said first inverted wall section to the bottom of said second inverted wall section;

a substrate having at least one contact area located within said housing; and a contact finger for placement in said housing aperture, said contact finger having at least a first portion, a second portion and a third portion, said first portion protruding below said aperture and contacting said contact area on the substrate, said second portion clipping on to opposing walls of said second inverted wall and said third portion protruding from said aperture forming an external contact area.

2. The electrical contact assembly of claim 1, wherein said assembly comprises a battery charger.

3. The electrical contact assembly of claim 1, wherein said contact finger comprises nickel silver.

4. The electrical contact assembly of claim 1, wherein said housing has more than one aperture and contact fingers arranged so that the contact fingers can be set at variable distances from each other and at various heights to accomodate different batteries.

5. The electrical contact assembly of claim 1, wherein said third portion of the contact finger further comprises an end portion having a tongue wider than the aperture in the housing.

6. The electrical contact assembly of claim 1, wherein said first inverted wall forms part of a well for receiving a rechargeable battery having charging contacts for mating with said third portion of the contact finger.

7. The electrical contact assembly of claim 6, wherein said first portion of the contact finger wipes the contact area of the substrate each time the rechargeable battery is firmly placed in the well.

8. An electrical contact assembly having an electrical contact for use in a housing having at least a first appending wall and a second appending wall, comprising:

a contact finger substantially fitted on an inner wall of the first appending wall and on an outer wall of the second appending wall for placement in a housing aperture, said contact finger having at least a first portion, a second portion, and a third portion, said first portion protruding below said aperture and contacting a contact area on a substrate located within said housing, said second portion clipping on to opposing walls of said second appending wall and said third portion protruding from said aperture forming an external contact area.

9. The electrical contact assembly of claim 8, wherein said assembly comprises a battery charger.

10. The electrical contact assembly of claim 8, wherein said contact finger comprises nickel silver.

11. The electrical contact assembly of claim 8, wherein said third portion of the contact finger is gold plated.

12. The electrical contact assembly of claim 8, wherein said third portion of the contact finger further comprises an end portion having a tongue wider than the aperture in the housing.

13. The electrical contact assembly of claim 8, wherein said first appending wall forms part of a well for receiving a rechargeable battery having charging contacts for mating with said third portion of the contact finger.

14. The electrical contact assembly of claim 13, wherein said first portion of the contact finger wipes the contact area of the substrate each time the rechargeable battery is firmly placed in the well.

15. A hand-insertable, hand-removable self-locking electrical contact for insertion into a housing opening in a housing having at least a first appending wall and a second appending wall formed therein, comprising a lower electrical contact portion for coupling to a contact on a substrate located within said housing;

a middle electrical contact portion for clipping on to opposing walls of said second appending wall; and an upper electrical contact portion protruding from said housing opening and forming and external contact area.

16. The electrical contact of claim 15, wherein said electrical contact comprises nickel silver.

17. The electrical contact of claim 15, wherein said upper portion of the electrical contact is gold plated.

18. The electrical contact of claim 15, wherein said upper portion of the electrical contact further comprises an end portion having a tongue wider than the aperture in the housing.

19. The electrical contact of claim 15, wherein said first appending wall forms part of a well for receiving a rechargeable battery having charging contacts for mating with said upper portion of the electrical contact.

20. The electrical contact assembly of claim 19, wherein said first portion of the contact finger wipes the contact area of the substrate each time the rechargeable battery is firmly placed in the well.

* * * * *